United States Patent [19]

Pollard et al.

[11] Patent Number: 4,688,008

[45] Date of Patent: Aug. 18, 1987

[54] LOCKING, ADJUSTABLE WAVEGUIDE SHORTING PISTON

[75] Inventors: David R. Pollard, South Lake Tahoe, Calif.; Robert H. Goldbach, Litchfield Park, Ariz.

[73] Assignee: Motorola, Inc., Schaumburg, Ill.

[21] Appl. No.: 825,179

[22] Filed: Feb. 3, 1986

[51] Int. Cl.[4] ..... H01P 1/28

[52] U.S. Cl. ..... 333/253; 333/99 R; 403/297

[58] Field of Search ..... 333/248, 253, 99 R, 333/209, 233; 411/75-77, 55, 80; 403/248, 249, 297, 370, 374

[56] References Cited

U.S. PATENT DOCUMENTS 2,437,889 3/1948 Nordsieck .
2,438,914 5/1948 Hansen .
2,666,186 1/1954 Williams .
2,675,524 5/1954 Collard .
2,829,352 4/1958 Hennies et al. ..... 333/253 X
2,944,234 7/1960 De Ronde .
3,049,684 8/1962 Vaccaro .
3,349,662 10/1967 Williams ..... 411/75 X
4,216,450 8/1980 Linke .

*Primary Examiner*—Paul Gensler
*Attorney, Agent, or Firm*—Lowell W. Gresham

[57] ABSTRACT

A waveguide shorting device having a shorting block and a wedge is disclosed. The shorting block contains a channel which is tapered so that it matches a taper of the wedge. A screw extends through the shorting block and engages a threaded hole in the wedge. Tightening the screw causes the wedge to be received in the channel and the shorting block to expand. Expansion of the shorting block clamps the shorting piston in a locked position within a waveguide.

12 Claims, 4 Drawing Figures

LOCKING, ADJUSTABLE WAVEGUIDE SHORTING PISTON

BACKGROUND OF THE INVENTION

This invention relates generally to waveguide shorting devices. Specifically, the present invention relates to waveguide shorting devices whose position can be adjusted within a waveguide and locked at a particular place.

Shorting pistons vary the length of a waveguide. The position of a shorting piston within a waveguide may adjust so that a precise optimum position can be achieved. Additionally, the shorting piston may advantageously present to incident energy traveling in the waveguide a surface which is relatively smooth, perpendicular to inner walls of the waveguide, and in physical contact with waveguide walls.

Previous shorting pistons fail to exhibit a sufficient number of desirable features. One prior shorting piston operates only with a specialized, non-standard waveguide. Such a shorting piston requires overall system expense to increase.

Many previous shorting pistons fit loosely within a waveguide so that they can move within the waveguide. These shorting pistons fail to sufficiently contact interior waveguide walls. Additionally, these shorting pistons do not reside in presisely the same position relative to the waveguide after the waveguide encounters a vibration. Resultingly, a vibration may cause characteristics of energy traveling within the waveguide to change.

Some previous shorting pistons use springs to hold a piston stationary within the waveguide yet permit the piston to move within the waveguide. However, a spring which is strong enough to hold the piston in place under the influence of vibration tends to scratch interior walls of the waveguide when the piston's position changes within the waveguide. Conversely, a spring which permits the piston to move within the waveguide without scratching the interior walls of the waveguide tends not to hold the piston in place when vibration occurs.

Yet another shorting piston uses conductive belts, spring loaded on rollers. This arrangement tends to be expensive and to present an undesirable surface to incident energy within the waveguide.

SUMMARY OF THE INVENTION

Accordingly, it is an object of the present invention to provide an improved shorting piston which can move within a waveguide without scratching interior waveguide walls.

Another object of the present invention concerns providing a shorting piston which can be locked in a precise position within a waveguide and remain in that positon in spite of vibration.

Yet another object of the present invention concerns providing an improved shorting piston which physically contacts interior waveguide walls in the vicinity of the shorting piston.

The above and other objects and advantages of the present invention are carried out in one form by a block, a wedge, and a fastener. The block's shape corresponds to the cross-sectional shape of a waveguide with which the shorting piston is used. The block contains a channel which receives the wedge. When the wedge is received within the channel of the block, a base section of the block expands and causes the shorting piston to clamp the interior walls of the waveguide. The fastener keeps the wedge retained within the channel of the block.

BRIEF DESCRIPTION OF THE DRAWINGS

A more complete understanding of the present invention may be derived by reference to the detailed description and claims when considered in connection with the accompanying drawings, in which like reference numbers designate similar parts, and wherein:

DETAILED DESCRIPTION OF THE PREFERRED EMBODIMENT

Figure 1:
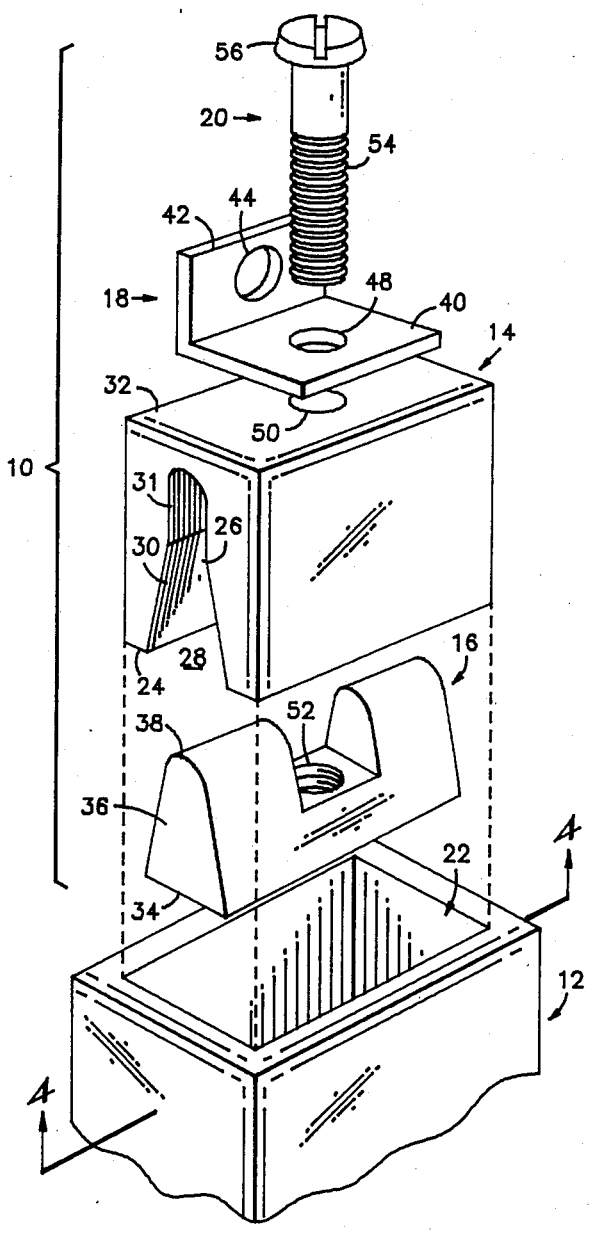
FIG. 1 shows an exploded perspective view of the present invention.

FIG. 1 shows a shorting piston 10 constructed according to the teaching of the present invention. Shorting piston 10 is shown in position relative to a waveguide 12. Shorting piston 10 includes a shorting block 14, a shorting wedge 16, an adjustment bracket 18, and a screw 20. In the preferred embodiment waveguide 12, shorting block 14, and shorting wedge 16 are all constructed from aluminum.

Waveguide 12 has a waveguide interior 22 with a predetermined cross-sectional shape. In this embodiment waveguide interior 22 has a rectangular cross-section. Waveguide interior 22 receives shorting block 14. Thus, the size and shape of shorting block 14 correspond to waveguide interior 22. In this embodiment embodiment shorting block 14 represents a rectangular block of similar proportion to waveguide interior 22. Shorting block 14 also has a cross-sectional area at a base 24 thereof which is less than the cross-sectional area of waveguide interior 22. The difference between the size of base 24 and waveguide interior 22 represents minimal distances necessary to permit free movement of shorting block 14 within waveguide 12 in spite of tolerance variations in the dimensions of waveguide 12 and shorting block 14. Thus, shorting block 14 conforms as closely as possible to the inner walls of waveguide 12.

Shorting block 14 contains a channel 26 therein which tapers from a relatively wide opening 28 at base 24 to a relatively narrow section 30 at the central area of the interior of shorting block 14. A channel extension 31 extends from narrow section 30 toward a top surface 32 of shorting block 14 and terminates near top surface 32 within the interior of shorting block 14. Top surface 32 opposes base 24 on shorting block 14. In the present embodiment channel 26 traverses the entire length of shorting block 14 along the longer dimension of the rectangle which defines the shape of shorting block 14.

Channel 26 receives shorting wedge 16 to lock shorting piston 10 within waveguide 12. The shape of wedge 16 corresponds to the shape of channel 26. In the preferred embodiment wedge 16 has an incident surface 34 in the shape of a rectangle. The length of incident surface 34 substantially equals the length of shorting block 14 along the longer dimension of the rectangle which defines the shape of shorting block 14. The width of surface 34 is larger than the width of channel 26 at opening 28 when wedge 16 is not received within channel 26.

A side 36 of wedge 16 resides perpendicular to incident surface 34, includes the width of surface 34 at one end thereof, and resembles a triangle. Side 36 tapers from a larger width at incident surface 34 to a relatively smaller width at a top portion 38 of wedge 16. The taper exhibited by side 36 substantially equals the taper exhibited by channel 26 from wider opening 28 to narrower section 30.

Adjustment bracket 18 represents a member having a block surface 40 and a back surface 42. Block surface 40 resides at a right angle to back surface 42 and adjacent to top surface 32 of shorting block 14. Additionally, block surface 40 is smaller than top surface 32 so that adjustment bracket 18 does not interfere with free movement of shorting piston 10 within waveguide 12. Back surface 42 contains a hole 44 centrally located thereon. The size and shape of hole 44 permits hole 44 to accommodate a J-shaped adjustment tool 46 (see FIG. 2).

Block surface 40 of adjustment bracket 18 contains a centrally located hole 48. Additionally, shorting block 14 contains a hole 50 centrally located on top surface 32 and extending perpendicularly toward base 24. Hole 50 opens into channel 26 within the interior of shorting block 14. Finally, wedge 16 contains a hole 52 centrally located on incident surface 34 and extending through wedge 16 perpendicularly toward shorting block 14. Hole 52 is threaded so that a threaded shaft portion 54 of screw 20 may be screwed into hole 52. When adjustment bracket 18, shorting block 14, and shorting wedge 16 allign for locking within waveguide 12, holes 48, 50, and 52 are colinear.

Figure 2:
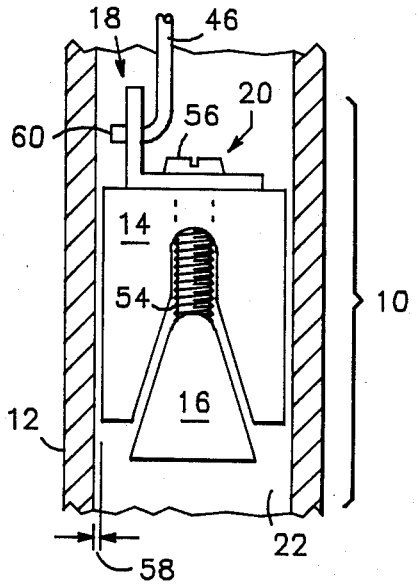
FIG. 2 shows a sectional side view of the present invention movable within a waveguide.

FIG. 2 illustrates the process of installing shorting piston 10 into waveguide 12. Threaded shaft 54 of screw 20 extends through hole 48 of adjustment bracket 18 and hole 50 of shorting block 14 and engages threaded hole 52 of wedge 16 (see FIG. 2). Hole 48 remains small enough so that a head portion 56 of screw 20 is blocked from passing through hole 48. Thus, adjustment bracket 18, shorting block 14, and wedge 16 are connected together in proximity to one another. However, screw 20 is not tightened, and wedge 16 is not fully received within channel 26 of shorting block 14. A tolerance gap 58 exists between shorting block 14 and waveguide 12 because base 24 of shorting block 14 is slightly smaller than interior 22 of waveguide 12. Accordingly shorting piston 10 may freely move within waveguide 12.

A hook 60 portion of adjustment tool 46 projects through hole 44 (see FIG. 1) of adjustment bracket 18. An end of tool 46 (not shown) opposing hook 60 extends outside waveguide 12. By moving tool 46 along the axial dimension of waveguide 12, shorting piston 10 moves axially within waveguide 12. Thus, using techniques well known to those skilled in the art, the position of shorting piston 10 within waveguide 12 may be adjusted until an optimum position is achieved. Tolerance gap 58 permits shorting piston 10 to move freely without scratching the interior walls of waveguide 12, and the range over which shorting piston 10 may be moved is limited by the length of tool 46.

Figure 3:
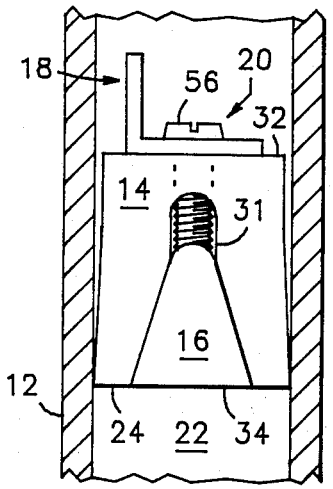
FIG. 3 shows a sectional side view of the present invention locked within a waveguide.

Shorting piston 10 locks within waveguide 12 by tightening screw 20, as shown in FIG. 3. Upon the tightening of screw 20, channel 26 of shorting block 14 receives wedge 16. Since incident surface 34 of wedge 16 is wider than opening 28 of shorting block 14, the receipt of wedge 16 into channel 26 causes base 24 of shorting block 14 to expand so that channel 26 can accommodate the larger size of wedge 16. As base 24 of shorting block 14 expands, it contacts the interior walls of waveguide 12 causing shorting piston 10 to be locked in place by clamping action against the walls of waveguide 12. The clamping force also tends to place screw 20 in tension due to the operation of wedge 16 against shorting block 14. Thus, screw 20 acts as a retainer. The tension on screw 20 prevents screw 20 from unscrewing and retains shorting block 14, wedge 16, and waveguide 12 in locked relative positions.

The width of incident surface 34 of wedge 16 may advantageously be controlled during the manufacture of shorting piston 10 so that a securing amount of torque applied to screw 20 in the tightening process causes incident surface 34 of wedge 16 to reside coplanar with base 24 of shorting block 14. Additionally, this securing torque may advantageously cause base 24 to expand sufficiently to clamp to waveguide 12 so that anticipated vibrations cannot cause the position of shorting piston 10 to change. The distance that channel extension 31 extends toward top surface 32 may be adjusted so that this securing torque does not become so great that risk of over-stressing screw 20 occurs. Finally, the length of screw 20 is chosen so that tightening screw 20 may advantageously refrain from causing an end of screw 20 which opposes screw head 56 from extending below incident surface 34 of wedge 16. Accordingly, installation of shorting piston 10 into waveguide 12 provides a substantially smoother surface to incident energy traveling in waveguide 12. Further, shorting piston 10 presents a surface which is substantially perpendicular to walls of waveguide 12, contacts walls of waveguide 12, and is locked in place.

Figure 4:
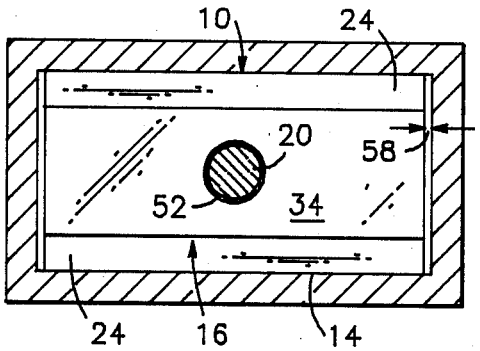
FIG. 4 shows a sectional bottom view taken across line 4—4 of FIG. 1.

FIG. 4 shows a bottom sectional view of shorting piston 10 installed within waveguide 12. Tolerance gap 58 no longer exists along the longer dimension of the rectangle which defines the shape of shorting block 14, but still exists along the shorter dimension of the rectangle. Screw 20 resides within hole 52 of wedge 16. Base 24 of shorting block 14 and incident surface 34 of wedge 16 block the remaining interior portion of waveguide 12.

The foregoing describes the present invention with reference to a preferred embodiment. However, those skilled in the art will understand that changes in form and detail may occur therein without departing fron the scope of the present invention. For example, although the foregoing description uses the terms "top" and "below" to clarify the teaching of the present invention, no particular relationship relative to the force exerted by gravity is required by the present invention. Further, the particular materials and shapes described above may be subject to significant variation without departing from the scope of the present invention. Many different metallic materials may be suitable for use in a shorting piston constructed according to the teaching of the present invention. Additionally, waveguide and shorting piston shapes need not resemble a rectangle as described above but may, for example, be circular. These and other changes and modifications obvious to those skilled in the art fall within the scope of the present invention.

What is claimed is:

1. A waveguide shorting piston installed in a waveguide having a predetermined cross-sectional shape, the piston comprising:

a block having a base, a cross-sectional shape substantially corresponding to the cross-sectional shape of the waveguide, and a channel extending into said block from the base of said block;

a wedge receivable in the channel of said block and shaped to cause the base of said block to expand when said wedge is received in the channel of said block; and means for fastening said wedge within the channel of said block, said fastening means being coupled to said block and to said wedge.

2. A shorting piston as claimed in claim 1 wherein each of said block and wedge is comprised of aluminum.

3. A shorting piston as claimed in claim 1 additionally comprising means, coupled to one of said block and said fastening means, for holding and positioning the shorting piston relative to the waveguide.

4. A shorting piston as claimed in claim 1 wherein:

said block has a hole therein;

said wedge has a threaded hole therein colinearly positioned with the hole in said block when said wedge is received in the channel of said block; and said fastening means comprises a screw having a head and a threaded shaft, the shaft passing through the hole in said block and engaging said wedge at the threaded hole therein, and the screw head being prevented from passing through the hole in said block.

5. A shorting piston as claimed in claim 1 wherein said wedge has a substantially planar incident surface which resides substantially coplanar with the base of said block when said wedge is received in the channel of said block.

6. A shorting piston as claimed in claim 5 wherein said fastening means refrains from extending through the incident surface of said wedge when said wedge is received in the channel of said block.

7. A method of varying the length of a waveguide having a predetermined cross-sectional shape, the method using a shorting piston having block and wedge portions and comprising the steps of:

forming the block to have a channel therein and to have a shape corresponding to the predetermined crosssectional shape of the waveguide;

shaping the wedge to be receivable in the channel of the block and to cause the block to expand when the wedge is received in the channel of the block;

positioning the block and wedge in the waveguide; and locking the shorting piston into the position determined in said positioning step by moving the wedge into the channel of the block.

8. A method as claimed in claim 7 wherein the block of said forming step has a base portion, and the wedge of said shaping step has an incident surface, and wherein said locking step comprises the step of moving the wedge into the channel of the block until the incident surface of the wedge resides substantially coplanar with the base of the block.

9. A method as claimed in claim 8 additionally comprising the step of retaining the wedge within the channel of the block.

10. A method as claimed in claim 9 wherein said retaining step comprises the step of utilizing a retainer to retain the wedge within the channel of the block and the method additionally comprises the step of preventing the retainer from extending through the incident surface of the wedge.

11. A waveguide shorting piston for insertion in a waveguide having a predetermined cross-sectional shape, the piston comprising:

a block having opposing base and top surfaces, a cross-sectional shape substantially corresponding to the cross-sectional shape of the waveguide, a channel extending into said block from the base of said block, and a hole extending from the top surface to the channel;

a wedge having a threaded hole and a substantially planar incident surface, said wedge being receivable in the channel of said block, shaped to cause the base surface of said block to expand when said wedge is received in the channel of said block, the hole in said wedge being colinear with the hole in said block when said wedge is received in the channel of said block, and the incident surface of said wedge being coplanar with the base surface of said block when said wedge is received in the channel of said block; and a screw having a head and a threaded shaft, the shaft passing through the hole in said block and engaging said wedge at the threaded hole therein, the head being prevented from passing through the hole in said block, and the threaded shaft being prevented from extending through the incident surface of said wedge when said wedge is received in the channel of said block.

12. A waveguide shorting piston for insertion in a waveguide having a predetermined cross-sectional shape, the piston comprising:

a block having a base, a cross-sectional shape substantially corresponding to the cross-sectional shape of the waveguide, and a channel extending into said block from the base of said block;

a wedge receivable in the channel of said block and shaped to cause the base of said block to expand when said wedge is received in the channel of said block, said wedge having a substantially planar incident surface which resides substantially coplanar with the base of said block when said wedge is received in the channel of said block; and means for fastening said wedge within the channel of said block, said fastening means being coupled to said block and to said wedge, and said fastening means refraining from extending through the incident surface of said wedge when said wedge is received in the channel of said block.

* * * * *